United States Patent [19]

Dietz

[11] 4,152,688

[45] May 1, 1979

[54] AIR FLOW SWITCH

[76] Inventor: Henry G. Dietz, 80 Salisbury Ave., Garden City, N.Y. 11530

[21] Appl. No.: 890,124

[22] Filed: Mar. 27, 1978

[51] Int. Cl.[2] ..... H01H 37/50

[52] U.S. Cl. ..... 338/215; 200/81.9 R; 307/118; 337/140; 337/395

[58] Field of Search ..... 200/81 R, 81.9 R; 338/215; 307/118; 340/606; 73/516 R, 700, 708; 337/123, 124, 131, 140, 395

[56] References Cited

U.S. PATENT DOCUMENTS

| | | | |
|---|---|---|---|
| 2,493,603 | 1/1950 | Thomas | 337/140 |
| 2,598,808 | 6/1952 | Ledin | 337/395 |

*Primary Examiner*—Gerald P. Tolin

[57] ABSTRACT

An electrical switch responsive to air flow having an insulated base with a snap action switch mounted thereupon. The snap action switch with an actuating pin impinging on one end of a bar that is mounted on a pivot and axially movable. The other end of the bar extends to clamp an alloy wire exhibiting a high linear coefficient of expansion and which is tied to a spring fixed on the insulated base. From same said spring a second alloy wire is extended to a fixed point on the insulated based in close proximity to the clamp on the bar. The first alloy wire is internally heated by a fixed voltage, the second alloy wire is internally heated by a voltage that is less than the fixed voltage and which is applied only when the snap action switch is deactuated. The second alloy wire provides means for obtaining temperature compensation and smaller differential between the actuating and deactuating air flow.

4 Claims, 3 Drawing Figures

AIR FLOW SWITCH

SUMMARY OF THE INVENTION

This invention relates generally to electrical switches and more particularly to a switch responsive to air flow.

Air flow switches are known. Generally, these switches are of three common types.

The first type, is the vane type of air flow switch where the air velocity acts upon a paddle that actuates a sensitive switch to make and break an electrical circuit. Generally, these switches are difficult to install, as it is hard to find a location free of ebby currents. Ebby currents will make the paddle flutter, which results in shortening the mechanical and electrical life of the sensitive switch. Another disadvantage is that the size of the paddle must become very large to obtain the necessary force to actuate the sensitive switch at low air velocity. The large size of the paddle is a disadvantage, as its weight is affected by gravity and cancels out the low forces produced by the air flow. Further difficulty occurs in that the paddle is sensitive to the direction of air flow, shock, and vibration.

The second type of air flow switch is one in which a differential pressure switch is actuated by the air velocity pressure. The majority of these differential pressure switches will actuate at a minimum value of 0.05 inches water gauge when the diaphragm size is limited to approximately 5 inches of diameter. This minimum actuation pressure requires a minimum air velocity of approximately 900 feet per minute. To obtain actuation of lower air velocity requires the diaphragm to be increased in size. Larger size diaphragms require more space for installation and makes the switch sensitive to shock and vibration.

The third type of air flow switch is one that is dependent upon a thermostatic device, where a change in temperature due to a lack of air flow actuates a sensitive switch. These devices must sense an increase in temperature before the sensitive switch is actuated. Since there is considerable lag when heat transfer takes place, the thermostatic types of switches are extremely slow in sensing air flow failure.

My invention overcomes the difficulties of the air flow switches previously described by using the hot wire method to detect air flow. The principal of air flow detection by a hot wire is well known. Air flow passing a hot wire will vary the resistance of the wire in accordance with the colling effect of the air flow passing by the wire. The detection of the change in resistance requires complicated auxilary equipment. My invention uses the hot wire, but does not use the property of change in resistance to detect air flow. The applicant's hot wire is an alloy that exhibits little change in resistance with variation in temperature. Instead the alloy used exhibits a high linear coefficient of expansion and a high specific resistivity and these properties are used to produce a simple air flow switch.

The primary feature of applicant's application is that very low rates of air velocity will actuate a sensitive switch.

Another feature of the invention is that the hot wire is of very small diameter having minimal mass and results in very rapid response of the air flow switch to changes in air velocity.

Another feature of the invention is that the size of the applicant's air flow switch is not dependent on an inverse ratio as with other air flow switches, where low air velocity requires larger size paddle or diaphragms. The applicant's switch can actuate on very low air flow and be of small physical size.

Another feature of the invention is that the applicant's air flow switch is temperature compensated and not affected by the change in the ambient temperature.

Another feature of the invention is that it is not affected by mounting position, shock, or vibration.

And another feature of the invention is that the difference between the point of actuation and deactuation can be controlled electrically, making it possible to have the air flow switch work on very little changes in the velocity of air flow.

The accompanying drawings, illustrative of one embodiment of the invention, together with description of their construction and the method of operation, and actuation, and utilization thereof, will serve to clarify further objects and advantages of the invention.

DESCRIPTION OF THE PREFERRED EMBODIMENTS

Figure 3:
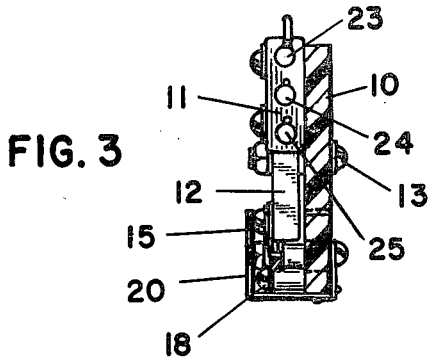
FIG. 3 is a top view of the air flow switch.

It will be understood that the following description of construction and the method of operation and actuation of the air flow switch is intended as explanatory and not restrictive thereof.

In the drawings, the same reference numerals designate the same parts throughout the various views.

Figure 1:
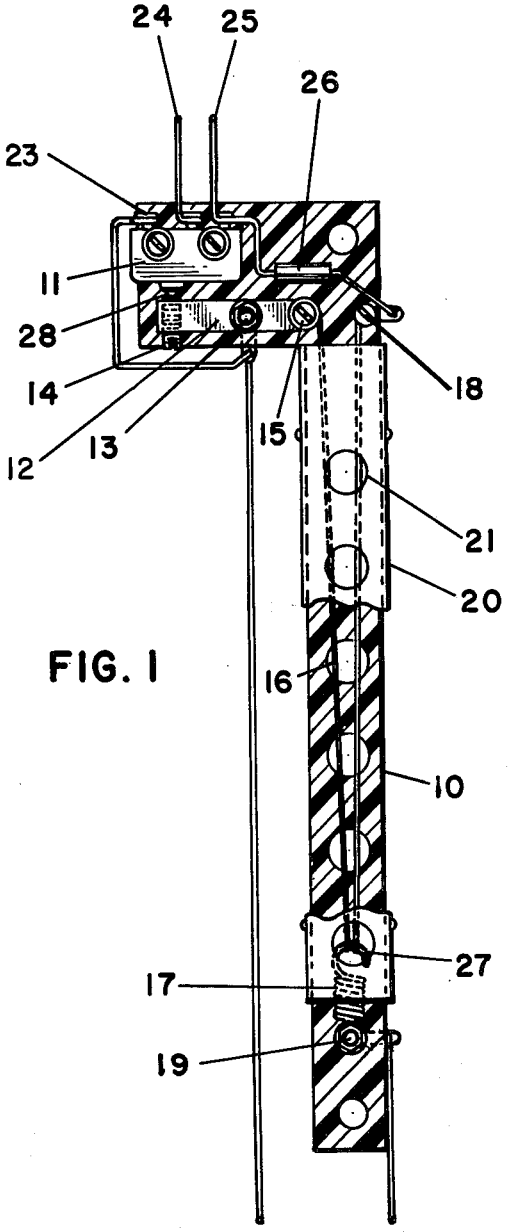
FIG. 1 is a front view of the air flow switch with the cover partially cut away to show the hot wires.

One embodiment of the air flow switch shown in FIG. 1, consists of a mounting base 10 made of a material that is an insulator, such as fiberglass impreginated with resin, or other suitable insulating material.

A snap-action switch 11 shown actuated incorporated therewith, mounted adjacent to the base 10 and attached thereof.

A bar 12 of substantially square cross section that is supported at its center by a pivot screw 13 which is fixedly attached to the base 10. Bar 12 is pivotally movable with one end having an adjustment screw 14 attached to said end. The opposite end of bar 12 has a threaded hole for accepting clamping screw 15. The clamping screw 15 clamps the small diameter wire 16. Wire 16 is an alloy exhibiting a high linear coefficient of expansion, high specific resistivity, and a very low temperature coefficient of resistance. An alloy consisting of a composition of 75% Ni 20% Cr and the balance of Al, Cu would be suitable, but not restrictive thereof. Wire 16 is looped and fastened to one end of the spring 17 mounted to base 10 by means of clamping screw 19 and one end extended to the clamping screw 15 on bar 12 with the other end extended to clamping screw 18 that is mounted on base 10 in close proximity to clamping screw 15.

Cover 20, of "U" shape cross-section is fastened to base 10 to provide protection to the wire 16, and also to impede the amount of air flowing past wire 16. Holes 21 are provided in the cover 20 and base 10. The size of holes 21 regulate the amount of air passing over wire 16 and enable the air flow switch to be used for actuation by high velocity air flow.

Suitable voltage is imposed on wire 16 between pivot screw 13 and clamping screw 19 to internally heat wire 16. Wire 16 expands when heated and the increase in its length deactuates the switch 11 by causing pivotal movement of bar 12 which in communication with adjustment screw 14 an actuator 28 on switch 11 actuate contacts to an inoperative position when no air flow is present. Switch 11 is a single pole double throw snap action switch and when actuated, terminal 23 is the common contact terminal, terminal 24 is the normally open contact, and terminal 25 is the normally closed contact. Plunger 28 activates switch when bar 12 is pivotally rotated in a clockwise direction. Switch is deactuated when bar 12 is pivotally rotated in a counter-clockwise direction. Snap action switch 11 has a plunger 28 that is normally maintained in the deactuated position by internal spring pressure.

Specific rate of air flow in the direction of arrow 22 will cool the heated wire 16 between pivot screw 13 and clamping screw 19 to fully dissipate the heat created by the voltage across clamping screw 15 and end of spring 27 resulting in decrease of the length of wire 16 to its original unheated length to actuate switch 11.

Wire 16 between clamping screw 15 and end of spring 17 is subject to expansion and contraction due to change in ambient temperature. To cancel out the effects of ambient temperature change, spring end 27 moves with the expansion and contraction of wire 16 between clamp screw 18 and spring end 27.

Spring end 27 adjusts to cancel out changes in length of wire 16 resulting from ambient temperature change, and temperature compensation of the air flow switch is accomplished.

Figure 2:
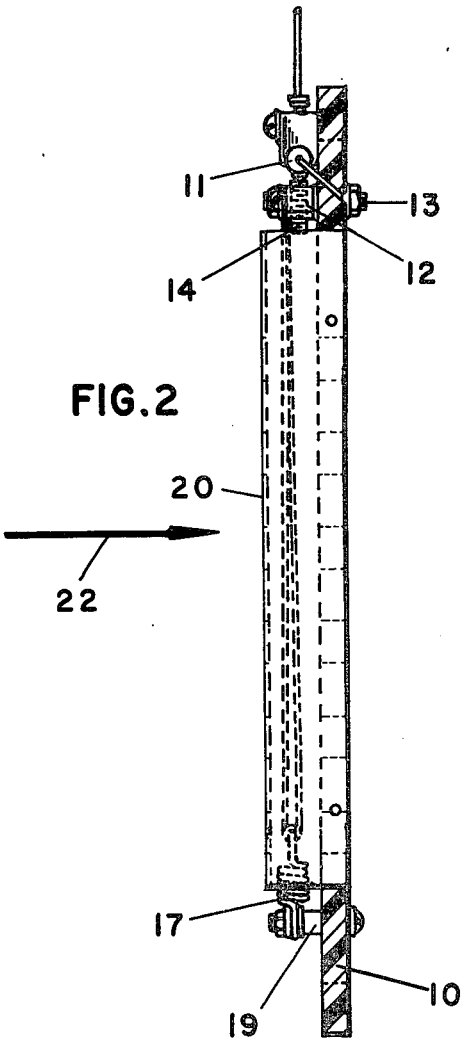
FIG. 2 is a side view of the air flow switch with an arrow showing the direction of air flow.

Sensitive switch 11 is a snap action type of switch shown in the actuated position in FIGS. 1, 2, and 3. Snap action switches are actuated when the plunger 28 is depressed for a fixed distance and will not deactuate until the plunger 28 returns to the release point which is less than the original distance for actuation. Distance between the point of actuation and point of deactuation is the on-off switch movement differential. The larger the on-off switch movement differential, the greater will be the difference in the change necessary in the air velocity to cool the heated wire 16 to produce the necessary change in length of wire 16 to actuate and deactuate switch 11.

Differential in air flow required for actuation and deactuation of switch 11 is directly proportional to the on-off switch 11 movement differential.

In order to obtain response to small changes in air flow it would be necessary to employ switches with smaller on-off switch movement differentials than can be obtained with the present state of the art.

This difficulty of switches with too wide differentials is overcome by applying a voltage, that is less than the voltage applied to pivot 13 by the voltage drop across resistor 26 to the normally closed contact 25 of switch 11. Voltage applied from normally closed contact 25 is applied to clamping screw 18 only when switch 11 is deactuated and there is no air flow. With no air flow wire 16 between screw clamp 18 and spring end 27 expands due to the internal heat of voltage applied at clamping screw 18 and tensions wire 16 between screw clamp 15 and spring end 27.

Said tension is applied as movement that is subtracted from the on-off switch 11 movement differential resulting in less cooling air being required for contraction of wire 16 between clamping screw 15 and spring end 27 to actuate switch 11 when wire 16 has full voltage applied at clamping screw 15.

Voltage drop across resistor 26 can be adjusted to provide actuation of switch 11 with minimum change in air flow velocity and maximum sensitivity to extreme low air flows.

The operation of the described air flow switch is not dependent on the availability of small on-off switch 11 movement differentials since this can be compensated for by applying the correct voltage across clamping screw 18 and spring end 27 as described above.

Control circuits requiring a voltage or lack of voltage when air flows can be obtained by using terminal 24 or 25 of switch 11 in conjunction with clamping screw 19.

Terminal 24, the normally open contact of switch 11 is actuated and a voltage present when the air flow of the correct value is present.

Terminal 25, the normally closed contact of switch 11 has a voltage present when the air flow is less than the correct value.

Isolation of the control circuits from the applied voltages can be obtained by using the output of either terminal 24 or 25 of switch 11 to operate a relay.

What I claim as new and desire to secure by Letters Patents of the United States is:

1. An air flow switch for sensing air flow and for actuating an electric switch when the sensed said air flow reaches a predetermined value, said air flow switch comprising, a base plate, a snap action switch mounted on said base plate, said snap action switch having an actuating pin, said actuating pin impinging on one end of a bar, said bar is mounted on a pivot and is pivotally movable, the other end of the bar extends to a clamp screw clamping one end of a first alloy wire thereto, said first alloy wire exhibits a high linear coefficient of expansion, the other end of said first alloy wire extends to a spring fixed on said base plate, from said spring a second identical alloy wire is extended to a fixed point on said base plate in close proximity to the clamp, said first alloy wire is internally heated by a fixed voltage applied across its length, said second identical alloy wire is internally heated by a voltage that is less than the fixed voltage, said less than the fixed voltage is obtained by a resistor in series with said second identical alloy wire, said less than the fixed voltage is applied only when said snap action switch is deactivated.

2. An air flow switch in accordance with claim 1 wherein said base plate is provided with apertures, said apertures forming a perforated passage, said perforated passage allows a predetermined amount of air to pass around said alloy wires, whereby said air flow switch can be calibrated to a specific rate of air flow by correct sizing of the said apertures in said base plate.

3. An air flow switch in accordance with claim 1 wherein a channel with a section that is three sides of a paralelogram protects said alloy wires, said channel cover is fastened to said base plate, said channel cover is provided with apertures, said apertures forming a perforated passage, said perforated passage allows a predetermined amount of air to pass around said alloy wires, whereby said air flow switch can be calibrated to a specific rate of air flow by correct sizing of the said aperatures in said channel cover.

4. An air flow switch in accordance with claim 1 wherein isolation of control circuits from applied voltage can be obtained by using the voltage output of said snap action switch to operate a relay.

* * * * *